United States Patent [19]

Shibata et al.

[11] Patent Number: 4,778,086

[45] Date of Patent: Oct. 18, 1988

[54] TONER REPLENISHING DEVICE

[75] Inventors: Kiyoshi Shibata; Kenji Oda, both of Osaka, Japan

[73] Assignee: Mita Industrial Co., Ltd., Osaka, Japan

[21] Appl. No.: 218,573

[22] Filed: Feb. 25, 1987

[30] Foreign Application Priority Data

Feb. 27, 1986 [JP] Japan ..... 61-043446
Feb. 27, 1986 [JP] Japan ..... 61-043447

[51] Int. Cl.[4] ..... B67D 3/00

[52] U.S. Cl. ..... 222/325; 141/364; 222/541; 222/DIG. 1

[58] Field of Search ..... 222/DIG. 1, 325, 541; 141/364, 367, 311 R; 206/633, 816; 220/345, 346, 260

[56] References Cited

U.S. PATENT DOCUMENTS

| | | | |
|---|---|---|---|
| 2,673,007 | 3/1954 | Debrie | 222/325 UX |
| 3,385,500 | 5/1968 | Lavander | 229/7 R |
| 4,062,385 | 12/1977 | Katusha et al. | 222/DIG. 1 X |
| 4,491,161 | 1/1985 | Tamura et al. | 141/364 |
| 4,573,614 | 3/1986 | Ozawa | 222/541 X |
| 4,614,286 | 9/1986 | Yamaguchi et al. | 222/541 X |
| 4,650,070 | 3/1987 | Oka et al. | 222/DIG. 1 X |

OTHER PUBLICATIONS

Abstract of 1493428, "Developing Apparatus", Xerox Corporation, May 19, 1975.

Abstract of 1533950, "Magnetic Brush Developer", Oce-Van Der Grinten NV, Aug. 19, 1977.

*Primary Examiner*—Kevin P. Shaver

*Attorney, Agent, or Firm*—Wenderoth, Lind & Ponack

[57] ABSTRACT

A toner replenishing device is improved to prevent unexpected dropping of toner when attaching a toner storage cartridge to a toner receptacle of a developer and detaching it therefrom. The cartridge is easily attached to the developer and is hooked in place thereto when a sheet sealing an open end of the cartridge is removed. The cartridge easily is detached from the developer by the operation of a cam portion engaging with a hooking member as a result of displacement of the cartridge by a distance equal to the thickness of the sheet and a sheet tearing member which previously are removed from the cartridge.

9 Claims, 8 Drawing Sheets

TONER REPLENISHING DEVICE

BACKGROUND OF THE INVENTION

1. Field of the Invention

This invention relates to toner replenishing device for use in developing means of an electrophotographic copying machine or facsimile, etc. More specifically, the invention relates to a toner storage cartridge having both a removable tear strip which seals an opening in the cartridge and a slidable cover which protects the tear strip during storage. The invention also relates to a device for fixing the toner cartridge to the developing means.

2. Description of the Prior Art

There is known a toner replenishing cartridge as disclosed in Japanese Utility Model Unexamined Publication No. 41364/1984. According to such known cartridge, it is easy to replenish a toner receptacle of a developing means with toner stored in a cartridge housing. The cartridge is so structured that the toner remaining in the cartridge housing can be prevented from falling or being scattered around the machine when pulling and detaching an empty cartridge housing from the device.

The known toner relenishing cartridge comprises, as illustrated in FIG. 11, guide members 17, 18 disposed on both sides of an open end 14 of a cartridge housing 15 for guiding or restricting the operations of inserting and removing the cartridge in the axial direction of a toner replenishing roller, a removable flexible sheet 22 sealing open end 14, a sheet-tearing member 23 formed by folding sheet 22 at the front end of cartridge housing in a direction reverse to the direction of cartridge insertion, a cover 24 slidable along guide members 17, 18 and covering sheet-tearing member 23 and sheet 22. The cartridge is inserted into the toner receptacle of the developing means while being disengaged from cover 24, and the sheet 22 is torn from the cartridge housing by pulling sheet-tearing member 23, whereby toner within housing 15 falls through open end 14 and replenishes the toner receptacle of the developing means. An empty cartridge housing 15 is removed without dropping or scattering any toner remaining in the cartridge housing 15 around the machine by positioning the cover 24 in a predetermined location and pulling the cartridge outwardly into the cover with the open end 14 of cartridge housing 15 closed by the cover 24. In this manner, the known cartridge is considered useful.

However, the known cartridge still can be improved with respect to its handling efficiency.

Thus, in the known toner replenishing cartridge A, as shown in FIG. 12, the cover 24 is liable to slide in the sheet tearing direction relative to the cartridge, since the cover 24 covering sheet 22 is relatively slidable in opposite directions. This can cause various problems. Thus, the sheet 22 sealing the open end 14 possibly can be torn, and toner unexpectedly can be dropped and/or scattered upon immediate tearing of the sheet 22 by pinching the held end of sheet 22 by the cover 24 when disengaging the cover 24. When an empty cartridge housing 15 is removed, as shown in FIG. 13, the cartridge housing 15 likely may overrun the cover 24. When such event occurs, any toner remaining in the cartridge housing 15 will be dropped and scattered as a result of uncovering the open end 14 of the cartridge housing 15 at the overrun position. Since the device has no mechanism functioning to fix the position of the toner cartridge, there is the inconvenience that the cartridge housing has to be held at a predetermined position by one hand and the sheet has to be torn by the other hand in order to prevent the toner cartridge from being removed when tearing the sheet. Also, the cartridge housing is apt to move undesirably due to mechanical vibrations of the machine housing during a copying operation. Such vibrations may be caused, for example, by the movement of an optical system unit including an exposure lamp or mirror in a movable optical system type copying machine, by the movement of a paper stand in a paper stand movable type copying machine, by rotation of a photoconductive drum or various rollers, etc., that tend to remove any toner adhered on the inside walls of the cartridge housing and to scatter them through the open end of the cartridge housing into the inside of the machine, and as a result, bring about problems of staining not only the inside of the machine but also paper sheets therein.

SUMMARY OF THE INVENTION

Accordingly, the object of this invention is to provide an improved toner replenishing cartridge which is free from the problems described above and which achieves efficient handling by a simple structural improvement.

One aspect of this invention relates to a toner replenishing cartridge comprising guide members disposed on both sides of the open end of a cartridge housing to guide movement of the cartridge during insertion and removal thereof. A removable flexible sheet seals such open end, and a sheet-tearing member is formed by folding the sheet at the front or inner end of the cartridge housing in a direction opposite to the direction of cartridge insertion. A cover is slidable along the guide members and covers the sheet-tearing member and the sheet. A stopper functions to prevent the cover from sliding in a direction that would cause the sheet to be torn from the cartridge housing by the action of the sheet-tearing member when the sheet-tearing member and the sheet are covered by the cover.

Another aspect of this invention relates to a toner replenishing device comprising a toner cartridge housing having an open end sealed by a flexible sheet connected to a sheet-tearing member folded at the front end of the cartridge housing in a direction reverse to the direction of cartridge insertion and which is insertable into and removable from a toner receptacle in the axial direction of a toner supplying roller. A hooking member functions to prevent dislocation of the toner cartridge housing from a predetermined position in the toner receptacle and is movable to allow the cartridge housing to be inserted into the predetermined position. A cam portion provided on the hooking member and for the cartridge housing functions to move the hooking member to a released position to enable withdrawal of the cartridge housing after removal of the sheet.

According to the toner replenishing device of this invention, the cover is prevented from sliding in a direction that would cause tearing of the sheet when the sheet and sheet-tearing member are covered by a cover. This prevents the occurrence of unexpected tearing of the sheet at the time of disengaging the cover, since the direction of relative movement upon disengaging the cover from the cartridge housing is restricted to be in a direction opposite to that causing tearing for removal of the sheet. Further, when pulling and removing an empty cartridge housing by utilizing the cover, the stopper prevents the empty cartridge housing from overrunning beyond the cover to thereby prevent any toner remaining in the empty cartridge housing from being dropped and/or scattered around the machine.

Further, according to the toner replenishing device of this invention, it is possible to insert the toner cartridge by a one touch operation and to remove the sheet by a single hand operation without dropping and/or scattering toner in the toner cartridge, since the toner replenishing device is provided with the hooking member functioning to secure the insertion of the toner cartridge to a predetermined position in the toner receptacle and to prevent it from being dislocated therefrom. Furthermore, according to the toner replenishing device of this invention, it is possible to slide out the cartridge housing after the removal of the sheet without conducting any additional operation, due to the cam portion and by ingeniously utilizing the thicknesses of the sheet and the sheet tearing member.

Further in addition, the toner replenishing device according to this invention is so structured that undesirable movements of the cartridge housing due to mechanical vibrations of the machine can be effectively prevented, whereby the toner in the cartridge housing can be prevented from being scattered into the machine, thereby eliminating not only straining of the inside of the machine but also papers therein with scattered toners. cl BRIEF DESCRIPTION OF THE DRAWINGS FIG. 1 is a longitudinal sectional view of a toner replenishing cartridge according to a preferred embodiment of this invention;

DESCRIPTION OF THE PREFERRED EMBODIMENT

This invention now will be described in detail with reference to the accompanying drawings which show a typical embodiment of the invention, but the invention is not limited to the specific features illustrated.

Figure 1:
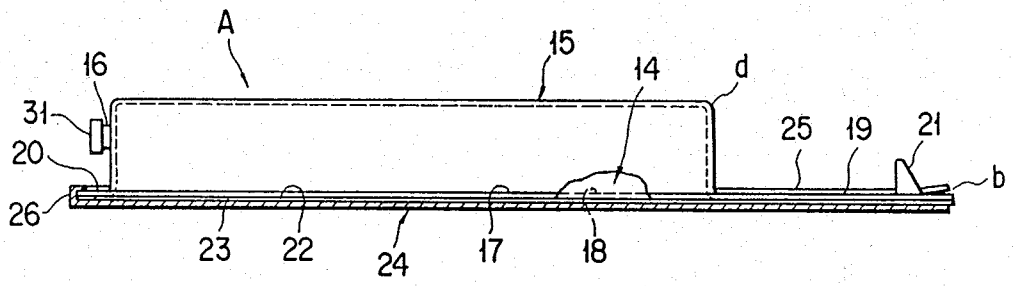
Figure 2:
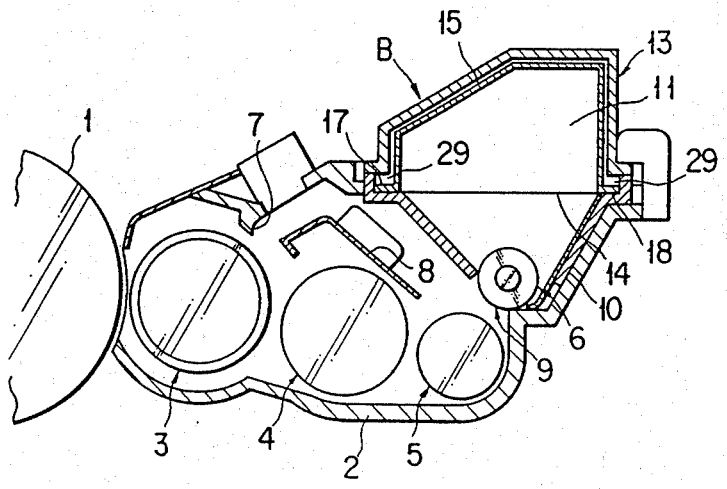
FIG. 2 is a longitudinal sectional view of a developing means having incorporated therein a toner replenishing device in accordance with the preferred embodiment of this invention.
Figure 3:
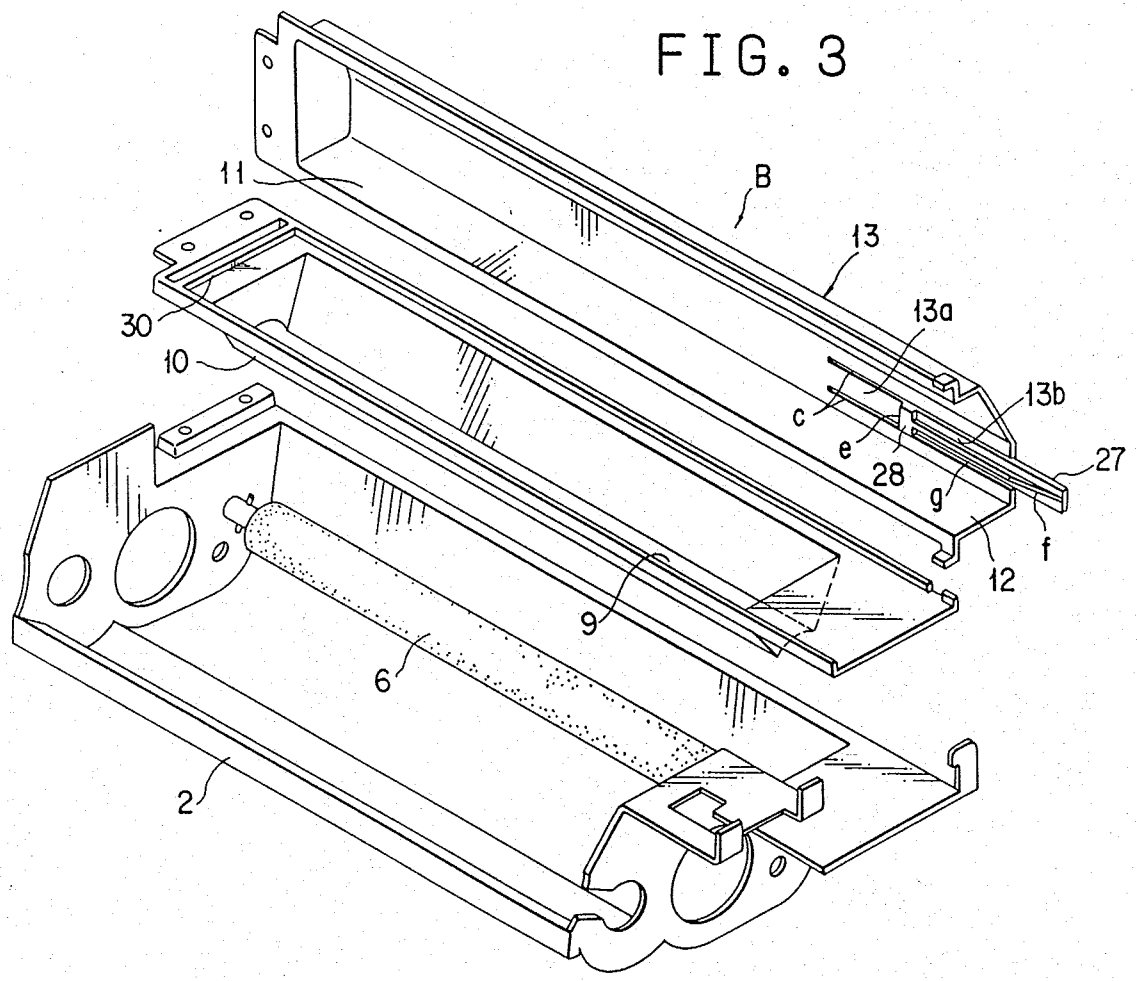
FIG. 3 is an exploded perspective view of the main parts constituting the developing means according to the preferred embodiment of this invention.

FIG. 1 illustrates a longitudinal sectional view of a toner replenishing cartridge A, and FIG. 2 and FIG. 3 illustrate detailed views of a developing means. The developing means is constituted as follows. In a developing case 2 opened at a portion thereof facing a photoconductive drum 1, there are disposed a developing sleeve, two rotary type mixers 4, 5, a toner supplying roller 6 made of sponge material or the like, a diaphragm 8 to circulate toner wiped by a blade 7 toward mixer 5 placed on the side of the toner supplying roller 6. A toner supplying hopper 10 is installed in the upper side end of case 2 with the supplying roller 6 facing a toner outlet 9, and a cartridge case 13 having an opening 15 one end and forming a toner chamber or receptacle 11 is disposed to cover an upper opening of the toner supplying hopper 10. A toner supplying device, wherein a housing 15 of toner replenishing cartridge A is disposed, is constituted mainly by toner supplying roller 6, toner supplying hopper 10 and cartridge case 13. The specific structure of the toner replenishing cartridge A will be explained below.

Figure 7:
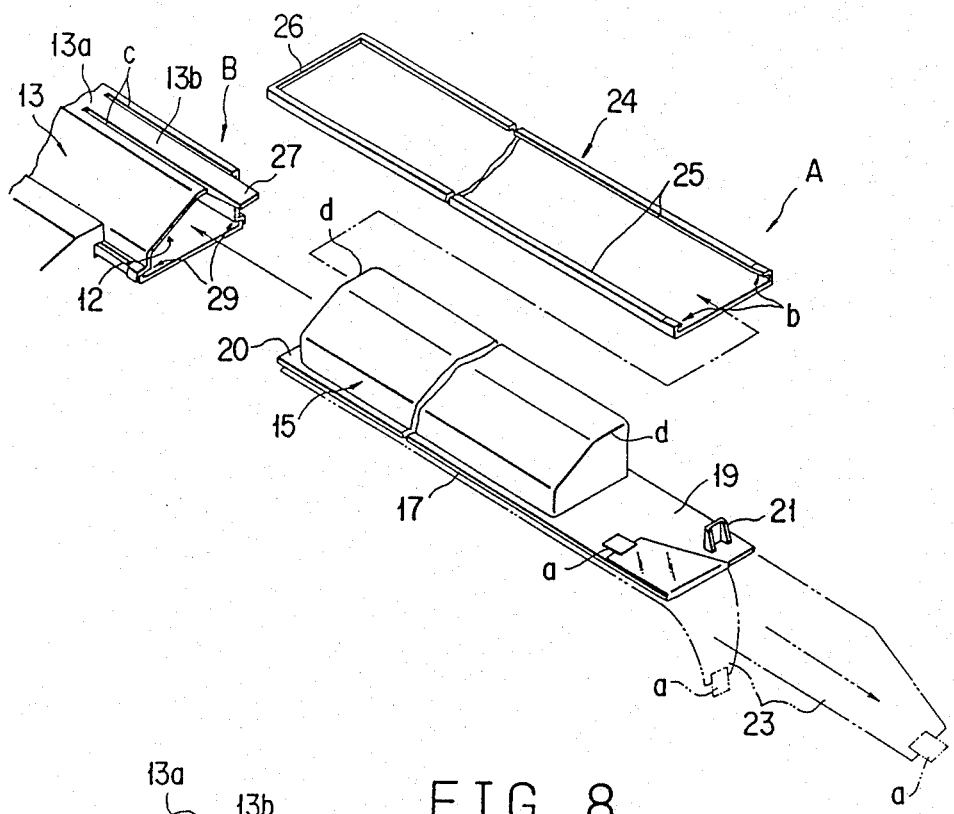
FIG. 7 is an exploded perspective view illustrating insertion of the cartridge housing into the toner receptacle according to the preferred embodiment of this invention.

Toner replenishing cartridge A is, as illustrated also in FIG. 7, formed by cartridge housing 15 and a cover 24. The cartridge housing 15 is elongated in the axial direction of toner supplying roller 6 and has a shape consistent with the internal shape of cartridge case 13. An open end 14 is provided at the bottom of cartridge housing 15 to replenish toner therethrough when the cartridge is inserted into toner recpetacle 11. The cartridge further includes a toner inlet 16 and rib-like flanges or members 17 through 20 around the periphery of open end 14. More specifically, among rib-like members 17 through 20, those on both longitudinal sides of the open end 14 are formed as guide members 17, 18 to guide or restrict the insertion and removal of the toner replenishing cartridge A to a direction axially of the toner supplying roller 6. On the upper surface of the rib-like member 19 placed at a side opposite the toner inlet 16 is a handle 21 for use in the operations of inserting and removing the cartridge. Open end 14 is sealed by a removable flexible sheet 22, and a sheet-tearing member 23 is formed by extending the front end of the sheet 22 along itself in a direction parallel to the direction of cartridge insertion (from the end of the cartridge opposite the end thereof having the handle 21 toward the handle 21), then its end portion is attached on the upper surface of the rib-like member 19 by means of a label or the like. The outer surface of every corner edge of the cartridge housing 15 is formed as a convex cam surface d.

A cover 24, shaped to encompass outer edges of rib-like members 17–20, includes rail portions 25 for slidably receiving the guide members 17, 18. Open ends b of the rail portions 25 are outwardly flared to facilitate insertion of the guide members 17, 18. At the opposite end of the rail portions 25 is a stopper 26 to receive an outer edge of the rib-like member 20 which is disposed opposite the rib-like member 19 where the handle 21 is disposed (or, as described below with reference to FIG. 8 and FIG. 9, an outer edge of the rib-like member 19 disposed on the side opposite to the side where the toner inlet 16 is placed).

The cover 24 is engaged with the guide members 17, 18 from the ends thereof where the sheet-tearing member 23 is folded and the cover is slid along the housing until the stopper 26 catches the outer edge of rib-like member 20, thereby covering the sheet 22 and sheet-tearing member 23 with the cover 24. Before or after the engagement of the cover 24, toner for use in replenishment is supplied into the cartridge housing 15 through the toner inlet 16 to fill up the cartridge housing and a cap 31 is put on the toner inlet, thereby obtaining a finished toner replenishing cartridge A as a unit.

According to the arrangement described above, and as will be apparent from FIG. 7, there is no possibility of tearing the sheet 22 unexpectedly when disengaging the cover 24 from the cartridge housing 15 when housing 15 is to be inserted into the toner receptacle 11, since the direction of disengaging movement of the cover 24 is in a direction opposite to the direction of tearing the sheet-tearing member 23, and since movement of cover 24 relative to housing 15 in the opposite direction is prevented by the action of the stopper 26.

Cartridge housing 15, members 16 through 21 connected thereto and cover 24 are made of hard or semi-hard plastics.

As illustrated in FIG. 3 through FIG. 8, two slits C extending in the direction of insertion and removal of the cartridge, are formed in an upper plate 13*a* of cartridge case 13 from an open end 12 thereof which accommodates the toner replenishing cartridge A. A vertically flexible member 13*b* between the slits C is elongated outwardly, thereby forming a handle 27 for releasing hooking in a manner described below.

Figure 5:
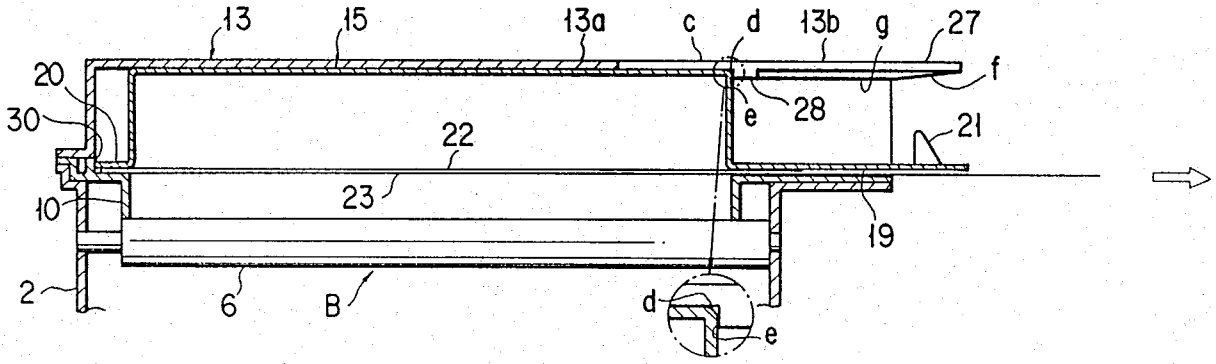
FIG. 5 is a longitudinal sectional view illustrating the manner of preventing the cartridge housing from being unintentionally removed according to the preferred embodiment of this invention.

As shown in FIG. 5, member 13*b* has an inwardly extending retaining or hooking member 28 to prevent unintentional withdrawal of the cartridge housing 15 by catching a portion slightly below cam portion d at the upper corner edge of the outer end of cartridge housing 15 when the cartridge housing 15, with the cover 24 disengaged therefrom, is in a predetermined position within the toner receptacle 11.

Further, as shown in the enlargement of FIG. 5, the hooking member 28 is so disposed that a hooking portion e of hooking member 28 will be engaged with cam portion d at the upper corner edge on the outer end of cartridge housing, due to downward displacement of the cartridge housing 15 after removal of the sheet 22 from the open end 14, that is, a downward displacement of the cartridge housing 15 equivalent to the combined thickness of sheet 22 and sheet-tearing member 23.

Figure 4:
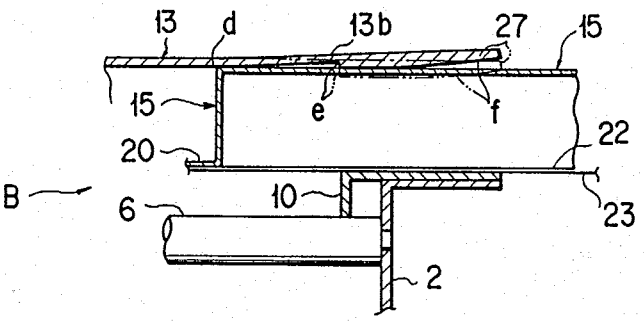
FIG. 4 is an explanatory sectional view illustrating insertion of a cartridge housing into a toner receptacle in accordance with the preferred embodiment of this invention.

Furthermore, handle 27 has a downwardly projecting plate or rib g having an inclined outer end surface f to facilitate the insertion of the cartridge. Accordingly, as illustrated in FIG. 4, by inserting the cartridge housing 15 into the toner receptacle 11, the guide members 17, 18 of the cartridge housing 15, after the cover 24 is removed therefrom, will be inserted into guide rails 29 formed between toner hopper 10 and cartridge case 13. During such insertion, the cam portion d at the upper corner edge on the inner or front end of the cartridge housing engages with inclined surface f of downwardly projecting rib g so that the handle 27, member 13b disposed between the slits C and hooking member 28 are flexibly deformed in a direction of releasing hooking, that is, upwardly, to thereby enable the cartridge housing 15 to be inserted into the toner receptacle by a simple one-touch operation.

As illustrated in FIG. 5, when the cartridge housing 15 is inserted into the toner receptacle 11 to a predetermined position where rib-like member 20 on the front or inner end of cartridge housing 15 abuts an upwardly projecting stopper 30 of the toner replenishing hopper 10, hooking member 28 returns to the initial position and is engaged with the portion slightly below cam portion d of the upper corner edge of the outer end of cartridge housing 15, thereby preventing unintentional removal of cartridge housing 15 from the toner receptacle 11.

Figure 6:
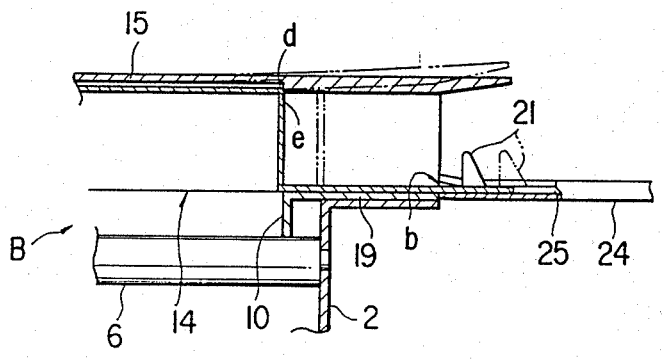
FIG. 6 is an explanatory sectional view illustrating removal of an empty cartridge housing in accordance with the preferred embodiment of this invention.
Figure 8:
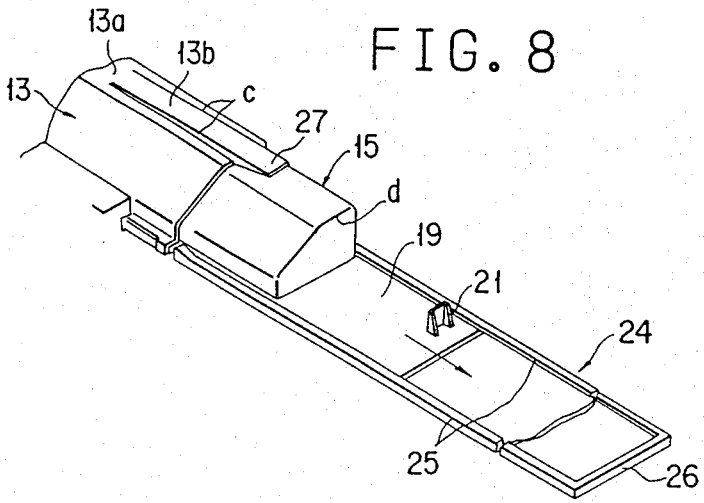
FIG. 8 is a perspective view illustrating detachment of the empty cartridge housing from the toner receptacle in accordance with the preferred embodiment of this invention.

Then, as illustrated in FIG. 7, label a is removed and member 23 is pulled in the direction of the arrow, whereby the sheet 22 closely adhered around the open end 14 of the cartridge housing 15 is torn off and toner stored in the cartridge housing 15 is released downwardly into the hopper 10. Further, as described above, hooking portion e of the hooking member 28 is engaged with the cam portion d at the upper corner edge of the outer end of the cartridge housing due to downward displacement of the housing after removal of the sheet 22 and member 23, thereby making it possible to prevent the movement of cartridge housing 15 due to mechanical vibrations of the machine. When it again is necessary to replenish hopper 10 with toner, as illustrated in FIG. 6 and FIG. 8, the handle 21 is pulled outwardly, thereby causing cam portion d to deflect the hooking member 28 in an outward direction to release hooking. Accordingly, the empty cartridge housing 15 easily can be slid out of receptacle 11 without any special releasing operation.

Alternatively, the hooking member 28 can be released by lifting handle 27 upwardly as occasion demands.

Figure 9:
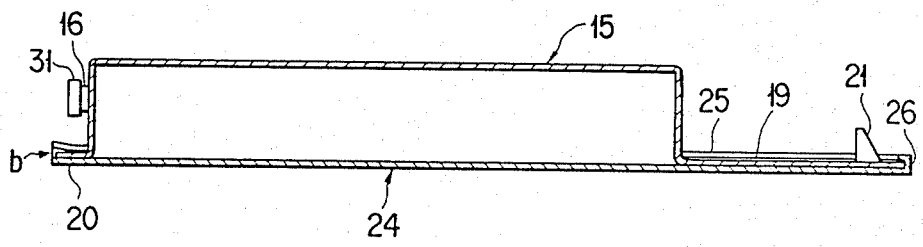
FIG. 9 is a longitudinal sectional view of the detached empty cartridge housing according to the preferred embodiment of this invention.

When the empty cartridge housing 15 is to be removed, there may be utilized again the same cover 24 that was removed from the toner replenishing cartridge A during the previous toner replenishment operation, or a cover 24 removed from a new toner replenishing cartridge A may be used. The flared open ends b of the rail portions 25 of the cover 24 on the side opposite stopper 26 are engaged with the rib-like member 19 of the housing 15 to be removed, handle 21 is pulled to move housing 15 in a direction into the cover 24, and the empty cartridge housing 15 is removed from the toner receptacle 11 so that the open end 14 of the empty cartridge housing 15 is closed by the cover 24 with rib-like member 19 abutting into stopper 26 of housing 15. This avoids overrun of the cartridge housing 15 beyond the cover 24. Accordingly, as illustrated in FIG. 9, the empty cartridge housing 15 can be removed conveniently without dropping and/or scattering any toner remaining in the empty cartridge housing 15 around the machine.

Subsequent insertion of a new cartridge housing 15 into the toner receptacle 11 for toner replenishment can be carried out as described above.

In the embodiment described above, although tearing member 23 of the sheet 22 is formed by elongating the sheet 22, several modifications of such arrangement are possible. For example, a tape-like member separate from the sheet 22 may be connected thereto.

Figure 10:
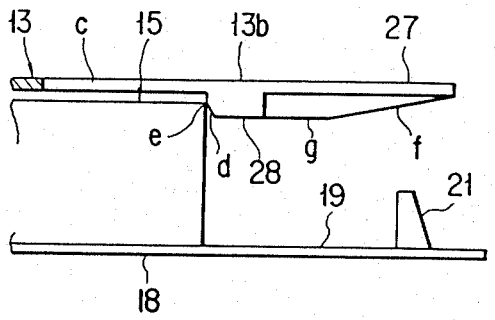
FIG. 10 is a partial longitudinal sectional view of a cam portion in accordance with a modification of the preferred embodiment of this invention.
Figure 11:
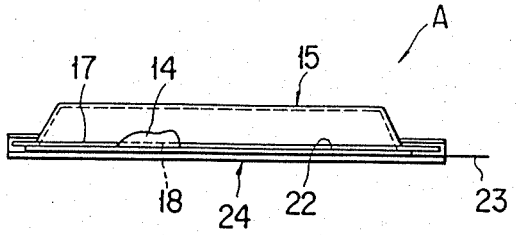
FIG. 11 PRIOR ART
FIGS. 11 through 13 are longitudinal sectional views of a known toner replenishing cartridge.
Figure 12:
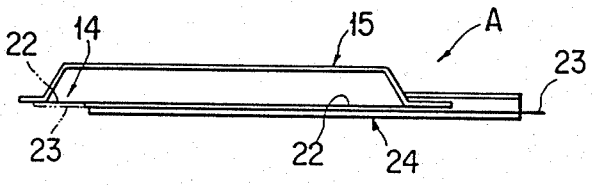
FIG. 12 PRIOR ART
Figure 13:
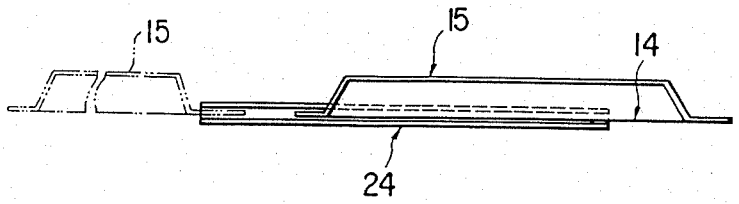
FIG. 13 PRIOR ART

Further, although convex cam portion d is formed at the upper corner of the outer front end of cartridge housing 15 to cause hooking member 28 to move outwardly to release hooking for removal of cartridge housing 15, the cam portion d may be formed on hooking member 28, as illustrated in FIG. 10, or cam portions d may be formed on both the hooking member 28 and cartridge housing 15.

What is claimed is:

1. A toner replenishing device for use in a developing apparatus, said toner replenishing device comprising:

a toner supply device including a toner supplying roller and a toner supply casing positioned above said roller, said casing defining therein a toner chamber open at an end thereof and opening downwardly to said roller;

a toner cartridge housing having an opening in the bottom thereof, a removable flexible sheet sealing said bottom opening and enclosing toner within the interior of said housing, and a sheet-tearing member connected to said sheet and having a free end removably attached to said housing;

said housing being slidably insertable into said toner chamber through said open end of said casing in a first direction parallel to the axis of said roller to a predetermined position above said roller, with said housing being supported by support surfaces of said casing;

said casing having retaining means for engaging said housing such that, upon detachment of said free end of said sheet-tearing member from said housing and pulling of said sheet-tearing member in a second direction opposite to said first direction, to thereby remove said sheet from said bottom opening of said housing such that said toner therein falls through said bottom opening to said roller, said housing is maintained in said predetermined position within said toner chamber of said housing without moving therefrom in said second direction;

said housing being displaced downwardly within said toner chamber within said casing, upon removal of said sheet-tearing member and said sheet, by a distance equal at least to the thickness of said sheet;

cam means, provided on at least one of said housing and said retaining means, for, upon pulling of said housing in said second direction, causing said retaining means to move out of engagement with said housing and enabling said housing, emptied of said toner, to be removed from said casing; and cover means, positionable adjacent an outer end of said housing, for, upon removal of said housing from said casing in said second direction, slidably receiving said housing and covering said bottom opening thereof, thereby preventing any toner remaining in said housing from scattering therefrom through said bottom opening.

2. A device as claimed in claim 1, wherein said sheet-tearing member comprises an integral extension of said sheet folded thereover.

3. A device as claimed in claim 1, wherein said cam means comprises a rounded upper corner edge of the outer end of said housing.

4. A device as claimed in claim 1, wherein said cam means is formed on said retaining means.

5. A device as claimed in claim 1, wherein said retaining means comprises a hook member formed on a flexible member formed integrally with said casing.

6. A device as claimed in claim 1, wherein said cover means includes means for preventing said housing from overrunning said cover means upon said removal of said housing from said casing in said second direction.

7. A device as claimed in claim 6, wherein said housing has extending from opposite sides of said bottom opening guide members extending parallel to said first and second directions, and said cover means has on opposite sides thereof rail portions dimensioned to slidably receive said guide members.

8. A device as claimed in claim 7, wherein said casing has at opposite sides thereof guide rails extending parallel to said first and second directions and dimensioned to slidably receive said guide members, said guide rails defining said support surfaces of said casing.

9. A device as claimed in claim 7, wherein said housing has at the outer end thereof a rib-like member, and said preventing means of said cover means comprises a stopper dimensioned to receive said rib-like member.

* * * * *

UNITED STATES PATENT AND TRADEMARK OFFICE

CERTIFICATE OF CORRECTION

PATENT NO. : 4,778,086

DATED : October 18, 1988

INVENTOR(S) : Kiyoshi SHIBATA et al.

It is certified that error appears in the above-identified patent and that said Letters Patent is hereby corrected as shown below:

Column 4, line 15, after "sleeve" insert --3--;

line 20, change "open-" to --open end 12--;

line 21, delete "ing 15 one end".

Column 5, line 47, after "housing" insert --15--.

Column 6, line 20, after "housing" insert --15--.

Column 7, line 32, change "housing" to --casing--.

Signed and Sealed this

Nineteenth Day of September, 1989

*Attest:*

DONALD J. QUIGG

*Attesting Officer*

*Commissioner of Patents and Trademarks*